US006616393B1

(12) United States Patent
Jentzsch

(10) Patent No.: US 6,616,393 B1
(45) Date of Patent: Sep. 9, 2003

(54) LINK COUPLING APPARATUS AND METHOD FOR CONTAINER BOTTOM REFORMER

(75) Inventor: K. Reed Jentzsch, Arvada, CO (US)

(73) Assignee: Ball Corporation, Broomfield, CO (US)

( * ) Notice: Subject to any disclaimer, the term of this patent is extended or adjusted under 35 U.S.C. 154(b) by 0 days.

(21) Appl. No.: 09/500,190

(22) Filed: Feb. 7, 2000

(51) Int. Cl.[7] ..... B21D 51/44
(52) U.S. Cl. ..... 413/67; 72/117
(58) Field of Search ..... 413/69; 72/117, 72/120, 122, 123, 126

(56) References Cited

U.S. PATENT DOCUMENTS

| | | | | |
|---|---|---|---|---|
| 744,672 | A | 11/1903 | Baeumle | |
| 854,426 | A | 5/1907 | Lowry | |
| 894,842 | A | 8/1908 | Lowry | |
| 994,468 | A | 6/1911 | Kane | |
| 1,031,264 | A | 7/1912 | Hinde et al. | |
| 1,441,674 | A | 1/1923 | Foster et al. | |
| 1,461,729 | A | 7/1923 | Foster et al. | |
| 1,524,106 | A | 1/1925 | Riegel | |
| 1,524,946 | A | 2/1925 | Nystrom | |
| 2,158,312 | A | 5/1939 | Terrel | |
| 2,612,204 | A | 9/1952 | Rickhoff | 153/32 |
| 2,618,182 | A | 11/1952 | Teetor | 80/5.1 |
| 2,624,303 | A | 1/1953 | Ghormley | |
| 2,654,413 | A | 10/1953 | Weidel | 153/80 |
| 2,737,996 | A | 3/1956 | Toth | 153/82 |
| 2,893,463 | A | 7/1959 | Kowal | 153/79 |
| 2,943,667 | A | 7/1960 | Ewing et al. | 153/80 |
| 3,382,699 | A | 5/1968 | Seeman | 72/355 |
| 3,417,898 | A | 12/1968 | Bozek et al. | 220/66 |
| 3,559,258 | A | 2/1971 | Gardner | 29/90 |
| 3,653,243 | A | 4/1972 | Ramseier | 72/122 |
| 3,687,098 | A | 8/1972 | Maytag | |
| 3,693,828 | A | 9/1972 | Kneusel et al. | 220/66 |
| 3,696,657 | A | 10/1972 | Maytag | 72/450 |
| 3,759,142 | A | 9/1973 | Maytag | 91/396 |
| 3,808,868 | A | 5/1974 | Wolfe | 72/353 |
| 3,831,416 | A | 8/1974 | Wolfe | 72/117 |
| 3,898,828 | A | 8/1975 | Cassai et al. | 72/117 |
| 3,904,069 | A | 9/1975 | Toukmanian | 220/66 |
| 3,905,507 | A | 9/1975 | Lyu | 220/66 |
| 3,942,673 | A | 3/1976 | Lyu et al. | 220/66 |
| 3,951,083 | A | 4/1976 | Hörtig | |
| 3,964,413 | A | 6/1976 | Saunders | |
| 4,070,888 | A | 1/1978 | Gombas | 72/91 |
| 4,108,324 | A | 8/1978 | Krishnakumar et al. | 215/1 |
| 4,120,419 | A | 10/1978 | Saunders | 220/66 |
| 4,134,354 | A | 1/1979 | Cvacho et al. | |
| 4,147,271 | A | 4/1979 | Yamaguchi | 220/70 |
| 4,151,927 | A | 5/1979 | Cvacho et al. | 220/70 |
| 4,199,073 | A | 4/1980 | Gombas | 220/66 |
| 4,280,353 | A | 7/1981 | Murphy | 72/345 |
| 4,289,014 | A | 9/1981 | Maeder et al. | 72/348 |
| 4,294,097 | A | 10/1981 | Gombas | 72/94 |
| 4,294,373 | A | 10/1981 | Miller et al. | 220/70 |
| 4,307,593 | A | 12/1981 | Riggs | 72/125 |
| 4,341,321 | A | 7/1982 | Gombas | 220/66 |
| 4,372,143 | A | 2/1983 | Elert et al. | 72/343 |
| 4,381,061 | A | 4/1983 | Cerny et al. | 215/1 C |

(List continued on next page.)

FOREIGN PATENT DOCUMENTS

| | | |
|---|---|---|
| AU | B-85992/91 | 9/1994 |
| EP | 0 482 581 A1 | 10/1991 |

*Primary Examiner*—Stephen F. Gerrity
*Assistant Examiner*—Louis Huynh
(74) *Attorney, Agent, or Firm*—Sheridan Ross P.C.

(57) ABSTRACT

Movement of rollers used for reforming an inner wall of a metal container bottom such as an aluminum beverage container is controlled at least partially using a rigid link coupled to other components of a reformer apparatus by a pin having a stepped profile. The stepped-profile pin preferably defines first and second shoulder regions. Undesired spaces or gaps in the pin-axial or thrust direction are reduced or eliminated by closely-positioning bushing flanges or thrust washers adjacent the shoulders.

14 Claims, 7 Drawing Sheets

U.S. PATENT DOCUMENTS

| | | | | | |
|---|---|---|---|---|---|
| 4,399,679 | A | | 8/1983 | King | 72/117 |
| 4,402,419 | A | | 9/1983 | MacPherson | 220/70 |
| 4,412,627 | A | | 11/1983 | Houghton et al. | 220/66 |
| 4,419,319 | A | | 12/1983 | Reynolds, Jr. et al. | 264/292 |
| 4,446,714 | A | | 5/1984 | Cvacho | 72/370 |
| 4,454,742 | A | | 6/1984 | Gombas | 72/115 |
| 4,470,281 | A | | 9/1984 | Kaporovich et al. | 72/68 |
| 4,515,284 | A | | 5/1985 | Lee, Jr. et al. | 220/70 |
| 4,519,232 | A | | 5/1985 | Traczyk et al. | 72/133 |
| 4,598,831 | A | | 7/1986 | Nakamura et al. | 215/1 |
| 4,599,123 | A | | 7/1986 | Christensson | 156/69 |
| 4,620,434 | A | | 11/1986 | Pulciano et al. | 72/347 |
| 4,650,628 | A | | 3/1987 | Evely | 264/531 |
| 4,685,582 | A | | 8/1987 | Pulciani et al. | 220/66 |
| 4,693,108 | A | | 9/1987 | Traczyk et al. | 72/370 |
| 4,717,523 | A | | 1/1988 | Evely | 264/527 |
| 4,723,430 | A | | 2/1988 | Hahn | 72/54 |
| 4,732,027 | A | | 3/1988 | Traczyk et al. | 72/133 |
| 4,732,292 | A | | 3/1988 | Supik | 220/70 |
| 4,768,672 | A | | 9/1988 | Pulciani et al. | 220/66 |
| 4,774,839 | A | | 10/1988 | Caleffi et al. | 72/354 |
| 4,834,256 | A | | 5/1989 | McMillin | 220/66 |
| 4,885,924 | A | | 12/1989 | Claydon et al. | 72/109 |
| 4,915,511 | A | * | 4/1990 | Kotegawa et al. | 384/127 |
| 4,919,294 | A | | 4/1990 | Kawamoto et al. | 220/70 |
| 4,953,738 | A | | 9/1990 | Stirbis | 220/606 |
| 5,040,682 | A | | 8/1991 | Palisin, Jr. et al. | 206/519 |
| 5,090,226 | A | | 2/1992 | Takeoka et al. | 72/117 |
| 5,105,973 | A | | 4/1992 | Jentzsch et al. | 220/606 |
| 5,111,679 | A | | 5/1992 | Kobayashi et al. | 72/348 |
| 5,154,669 | A | | 10/1992 | Weiss et al. | 464/69 |
| 5,222,385 | A | | 6/1993 | Halasz et al. | 72/117 |
| 5,325,696 | A | | 7/1994 | Jentzsch et al. | 72/117 |
| 5,355,709 | A | | 10/1994 | Bauder et al. | 72/356 |
| 5,433,098 | A | | 7/1995 | Bowlin et al. | 72/117 |
| 5,467,628 | A | | 11/1995 | Bowlin et al. | 75/126 |
| 5,661,904 | A | * | 9/1997 | Loughlin | 29/888.01 |
| 5,704,241 | A | | 1/1998 | Babbitt et al. | 72/117 |
| 5,706,686 | A | | 1/1998 | Babbit et al. | 72/117 |

* cited by examiner

LINK COUPLING APPARATUS AND METHOD FOR CONTAINER BOTTOM REFORMER

The present invention relates to a link coupling used in a reformer for beverage or other container bottoms and, in particular, to a link coupling using a stepped pin.

BACKGROUND INFORMATION

In certain metal container fabrication processes, including those used for producing aluminum beverage containers, strength, durability and/or resistance to damage of the container can be enhanced by providing predetermined shapes or profiles of the can bottom portion. Certain shaping procedures involve use of a reforming apparatus which employs a pivoting rigid link for positioning and/or controlling motion of a reforming roller. In previous approaches, a substantially cylindrical pin is used for coupling the rigid link to other components of the reformer. The pivot connection(s) between the link and other components is susceptible to wear. The rapidity with which wear occurs accordingly affects the frequency at which the pins and/or associated bushings and the like, must be replaced. Replacement of these parts typically requires shutting down a production line with disadvantageous economic consequences. In some cases maintenance is performed substantially off line, often including replacing the rams. Accordingly, it would be useful to provide a configuration and method for reforming which can reduce wear on the reformer link assembly (or components thereof) and/or otherwise reduce the frequency at which production lines must be shut down for reformer maintenance or repair.

Furthermore, as reformer components wear, there may be deterioration in the precision with which the roller is positioned and thus departure of the container bottom shape from the intended shape or position. Such departures can reduce the container's strength, durability or resistance to damage. Accordingly, it would be useful to provide a reformer configuration and method which can reduce and/or delay wear-induced departures of container bottom shapes from intended shapes.

Once it is determined that a reformer should be repaired or maintained, the magnitude of the economic disadvantage flowing from the shut-down of a production line is related to the amount of time required to perform the repair or maintenance. Accordingly, it would be useful to provide an apparatus and method in which repair or maintenance of a reformer, and particularly of pins and/or bushings used in a reformer link assembly, can be performed relatively rapidly (e.g. compared with previous apparatus and methods) preferably in a substantially standardized fashion.

SUMMARY OF THE INVENTION

The present invention includes a recognition of the existence, nature and/or source of certain problems of previous approaches and devices, including as described herein. According to one aspect, the present invention involves the use of a link pin which has a stepped, rather than a cylindrical, profile. Preferably, the stepped pin is used in conjunction with a flanged bushing. Without wishing to be bound by any theory, it is believed that increased lifetimes and reduced wear achieved using embodiments of the present invention are at least partially attributable to the reduction or elimination of axial gaps or spacings which commonly occurred between components in previous configurations or approaches.

In at least some embodiments, increases in lifetimes and/or reductions in frequency of maintenance or repair involves the use of high-wear-resistant bushings for contacting the link pins, including ceramic bushings.

In one aspect, movement of rollers used for reforming an inner wall of a metal container bottom such as an aluminum beverage container is controlled at least partially using a rigid link coupled to other components of a reformer apparatus by a pin having a stepped profile. The stepped-profile pin preferably defines first and second shoulder regions. Undesired spaces or gaps in the pin-axial or thrust direction are reduced or eliminated by closely-positioning bushing flanges or thrust washers adjacent the shoulders.

DETAILED DESCRIPTION OF THE PREFERRED EMBODIMENT

Figure 1A:
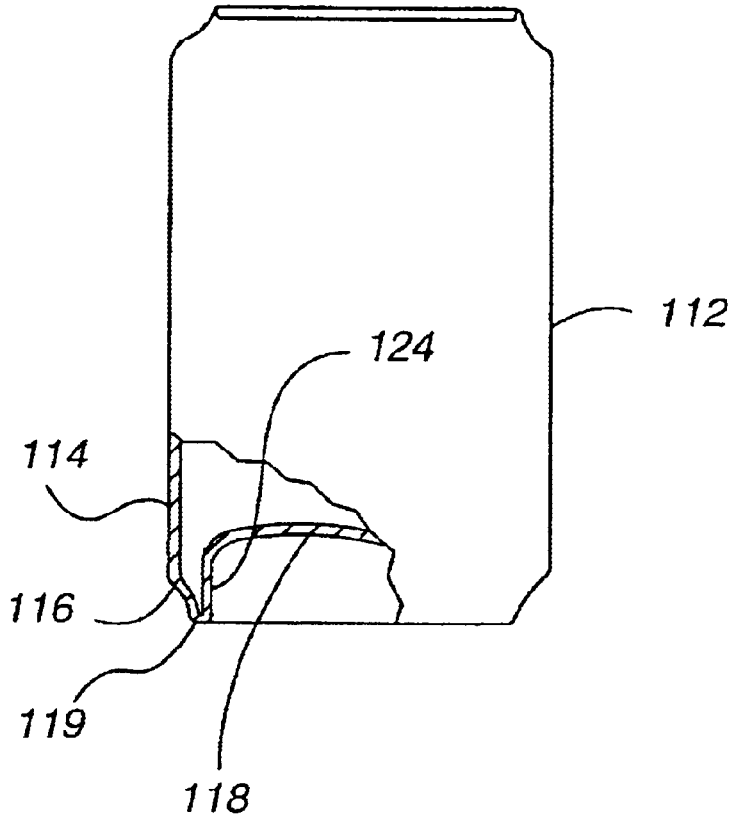
FIG. 1A is an elevational view, partially in cross-section, depicting a container end profile prior to reforming.

Before describing certain features of the present invention, certain general aspects of reforming will be described. As depicted in FIG. 1A, a container body 112, after initial forming, but before reforming, includes a generally cylindrical sidewall 114, an outer bottom wall 116, a domed bottom panel 118, a generally annular support surface 119 and a substantially flat or cylindrical wall 124 coupling the annular support surface 119 to the dome 118.

Figure 1B:
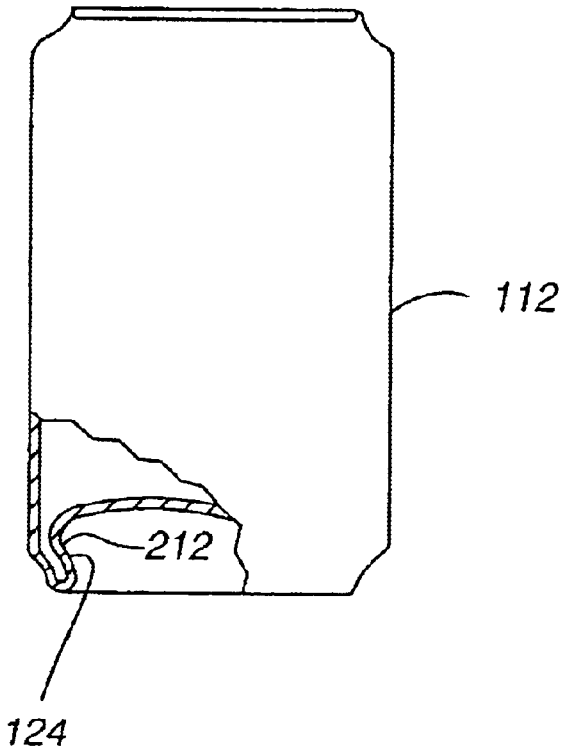
FIG. 1B depicts the container end of FIG. 1A, but after reforming.

Reforming involves changing the shape of the inner wall 124. In one approach, the inner wall 124 is reformed as depicted in FIG. 1B to include a radially outwardly-extending groove or crease 212. Typically, the groove or crease 212 extends substantially the entire circumferential extent of the inner wall 124. The position, magnitude and shape of the groove 212 can affect the strength, durability and/or damage-resistance of the container. Accordingly, it is generally desired to provide accurate control of reforming apparatus. Examples of reforming apparatus and methods are described in U.S. Pat. Nos. 5,706,686 and 5,704,241, incorporated herein by reference.

Figure 2A:
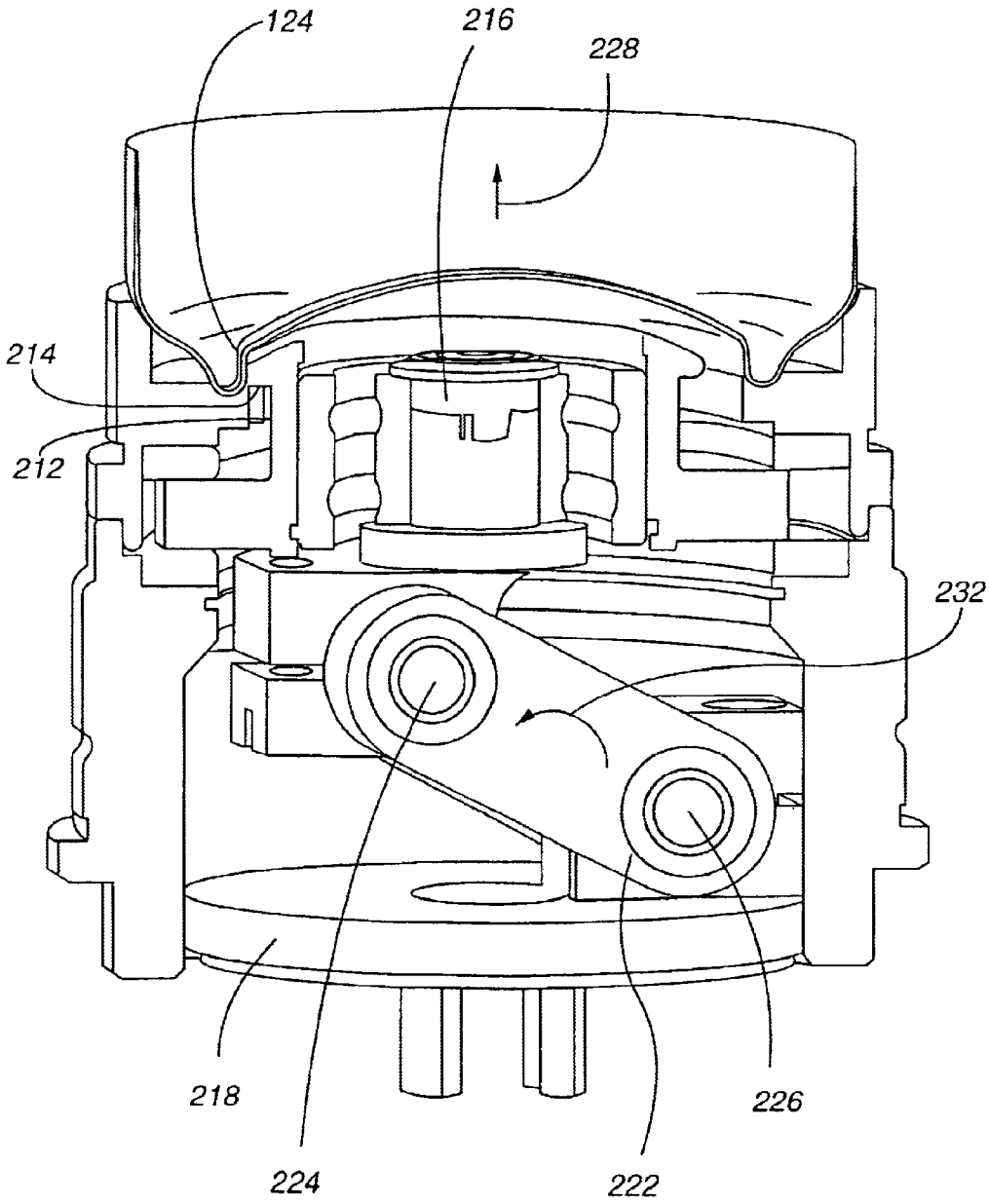
FIGS. 2A, B and C depict successive stages of a reformer's engagement with a container end, partially cutaway.

As depicted in FIG. 2A, in at least one type of reforming apparatus, a roller body 212 defines a roller reforming annular nose 214 for initially contacting, and then, reforming, the container bottom inner wall 124. The reforming roller 212 is mounted to a post 216 which is moveably coupled to a pivot base 218. The coupling is by way of a rigid "H" link 222. The H-link 222 is pivotable, with respect to the post 216, about a first pivot axis 224 and is pivotable with respect to the pivot base 218 about a second pivot axis 226.

The post 216 is substantially constrained from movement in an axial direction 228 but has a degree of freedom of movement in radial and rotational directions (perpendicular to and about the axial direction 228). When an upward axial force is applied to the pivot base 218, constraints on axial movement of the post 228 result in pivoting 232 of the H-link 222, e.g., from the position depicted in FIG. 2A toward the position depicted in FIG. 2B causing radially outward movement 234 (FIG. 2B) of the roller 212, resulting in a engagement of the roller nose 214 with the container bottom inner wall 124. Continued axial force provides further pivoting 236 of the H-link 222 from the position depicted in FIG. 2B to the fully engaged position depicted in FIG. 2C. As the roller 212 is moved radially to achieve engagement with, and deformation of (reforming of) the container bottom inner wall 124, rotation 238 of the pivot base 218, e.g., about an axis parallel to the container longitudinal axis 242 propagates the inner wall reforming substantially fully around the circumference of the container inner wall 124 to achieve the desired reforming.

Figure 2B:
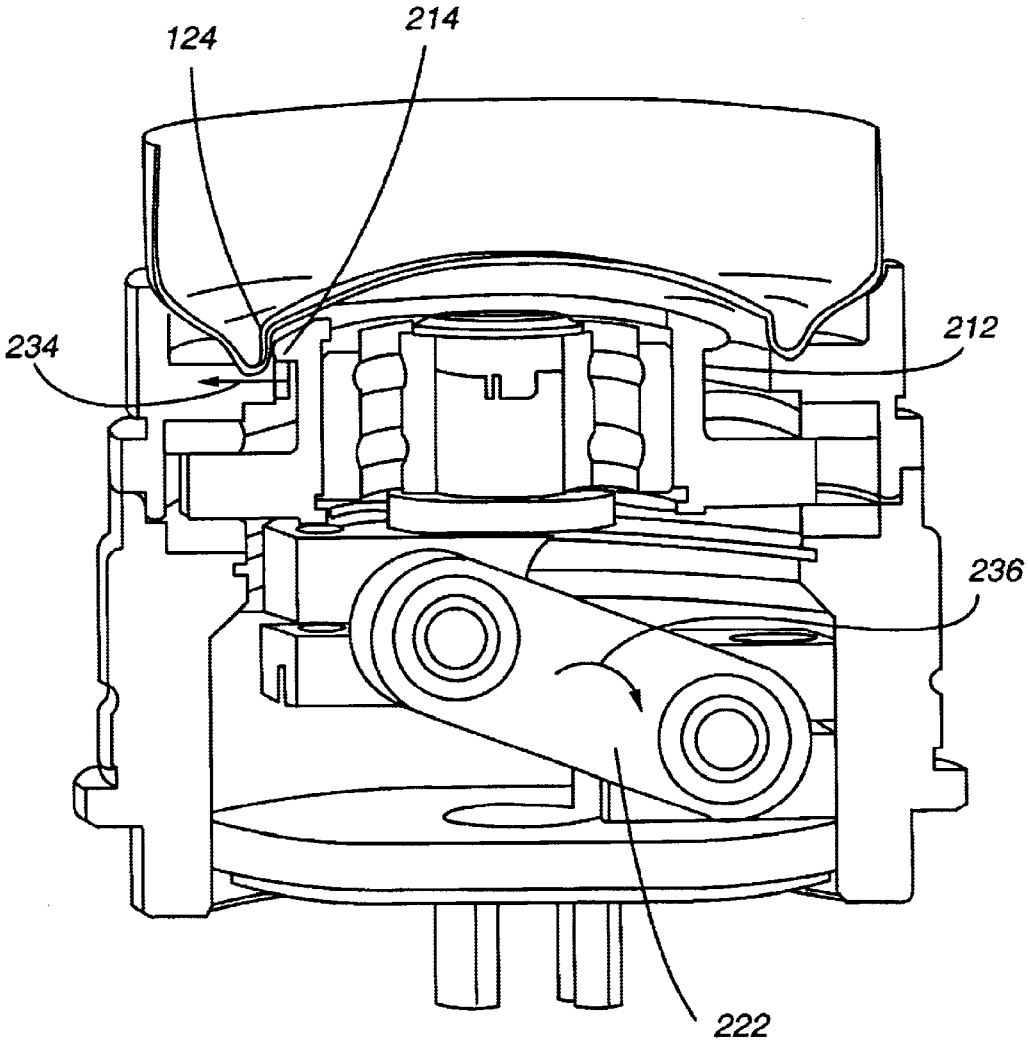
Figure 2C:
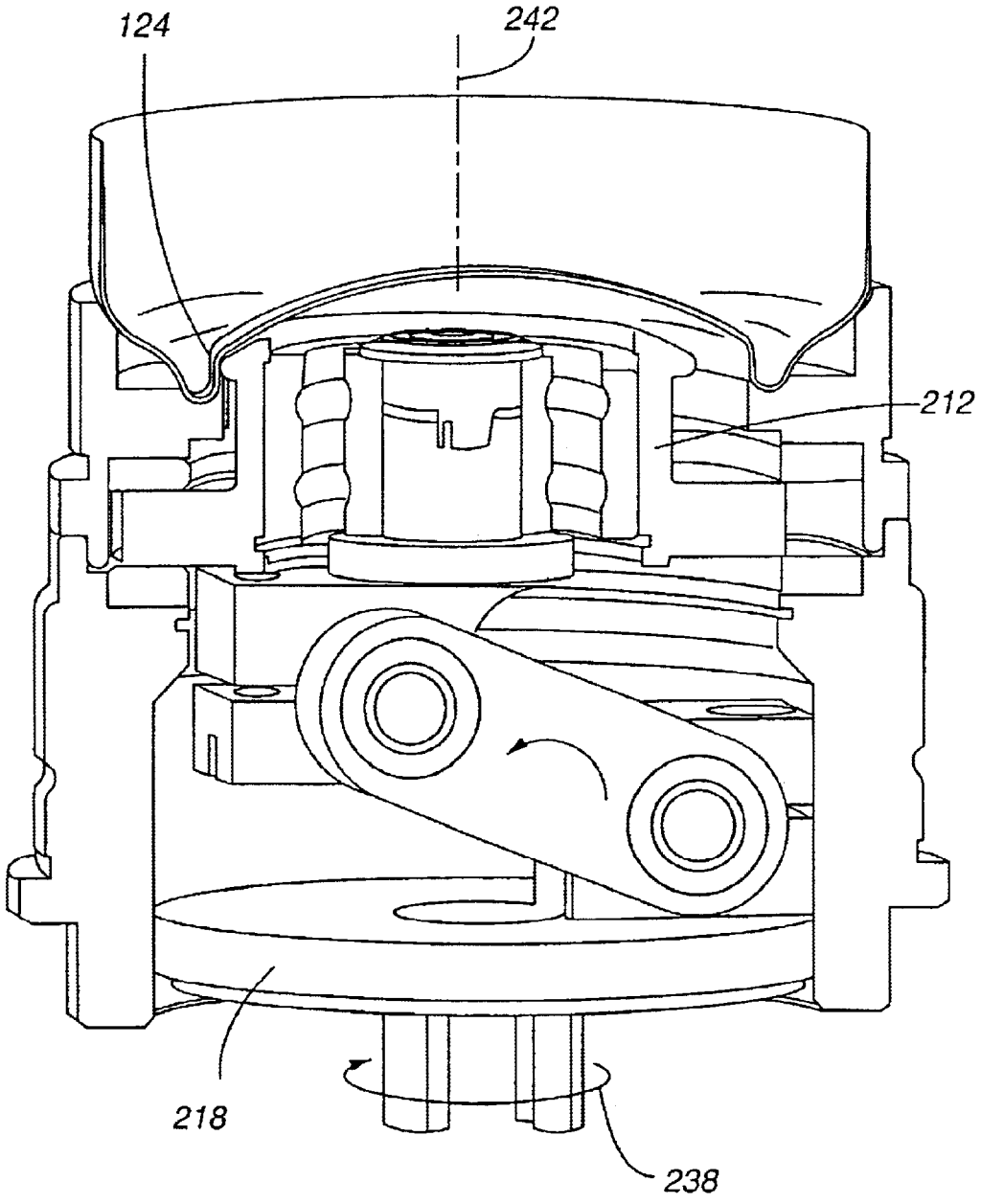
Figure 3:
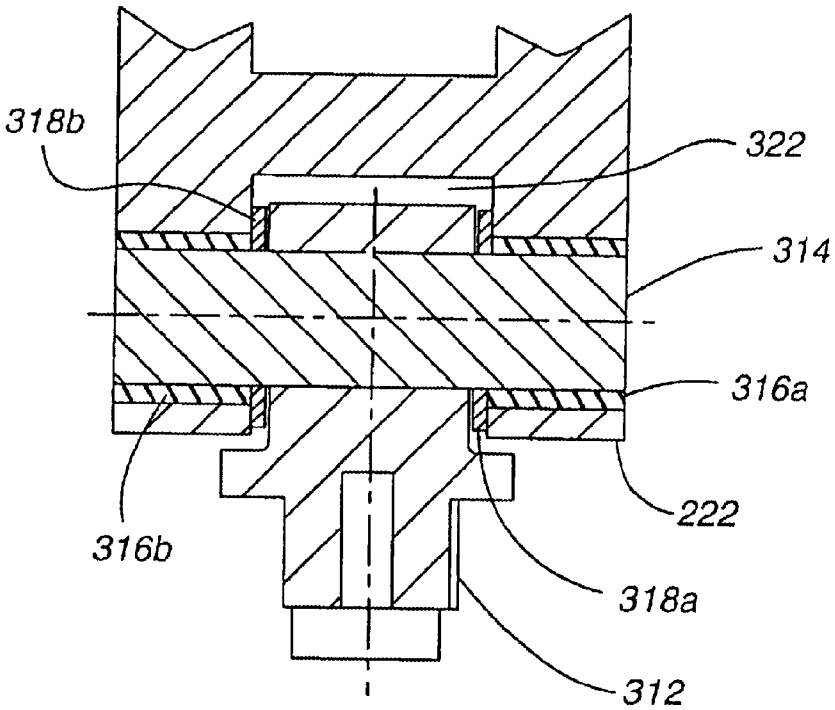
Fig. 3 Prior Art
FIG. 3 is a cross-sectional view of a link connection with a pivot arm according to previous approaches.

Thus, as seen from FIGS. 2A to 2C, the H-link 222 is provided with two pivot couplings, defining the two pivot axises 224, 226. In at least some previous approaches, the H-link 222 was coupled, e.g., to a pivot arm 312 using a substantially cylindrical pin 314 (FIG. 3). Typically, two straight or cylindrical bushings 316*a* 316*b* provided radial connection between the pin 314 and the H-link 222 and axial (i.e. with respect to the pin longitudinal axis) positioning was provided using first and second thrust washers 318*a* 318*b*. Not uncommonly, manufacturing variations, tolerances and/or wear resulted in a spacing or gap 322 between the thrust washers 318*a* and other components of the system such as the pivot arm 312. Without wishing to be bound by any theory, it is believed that the presence of a gap 322 can contribute to wear and reduction in effective part lifetimes. In some circumstances, shims were used for reducing or filling-in the gap, but such shims can cause wear on the pin and create undesirable particles in the mechanism.

Figure 4:
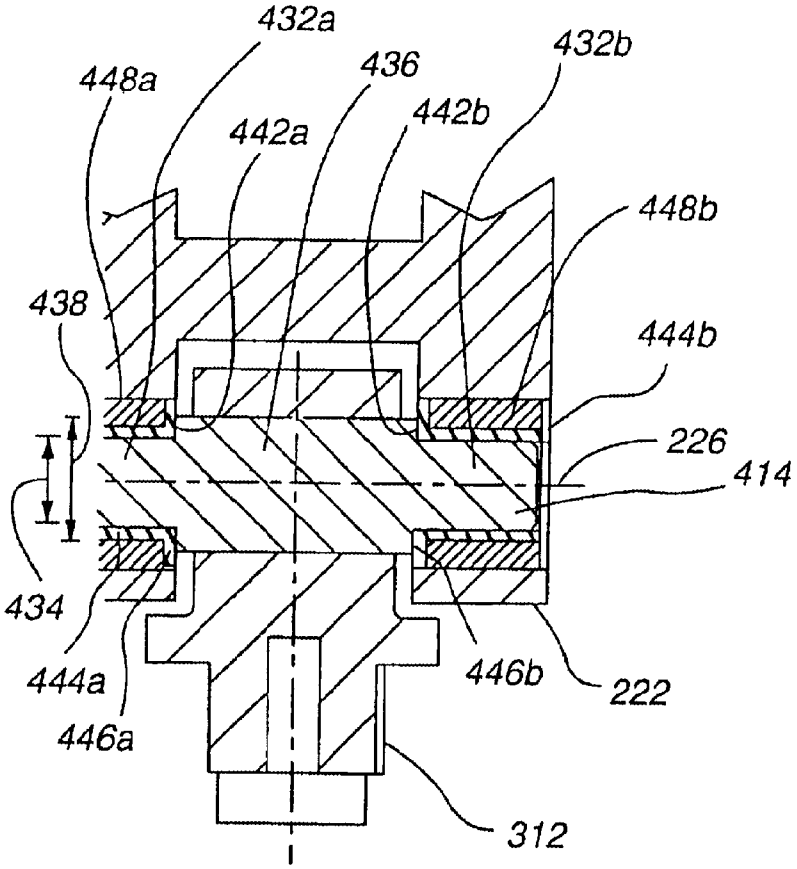
FIG. 4 is a cross-sectional view of a link connection with a pivot arm according to an embodiment of the present invention.
Figure 5:
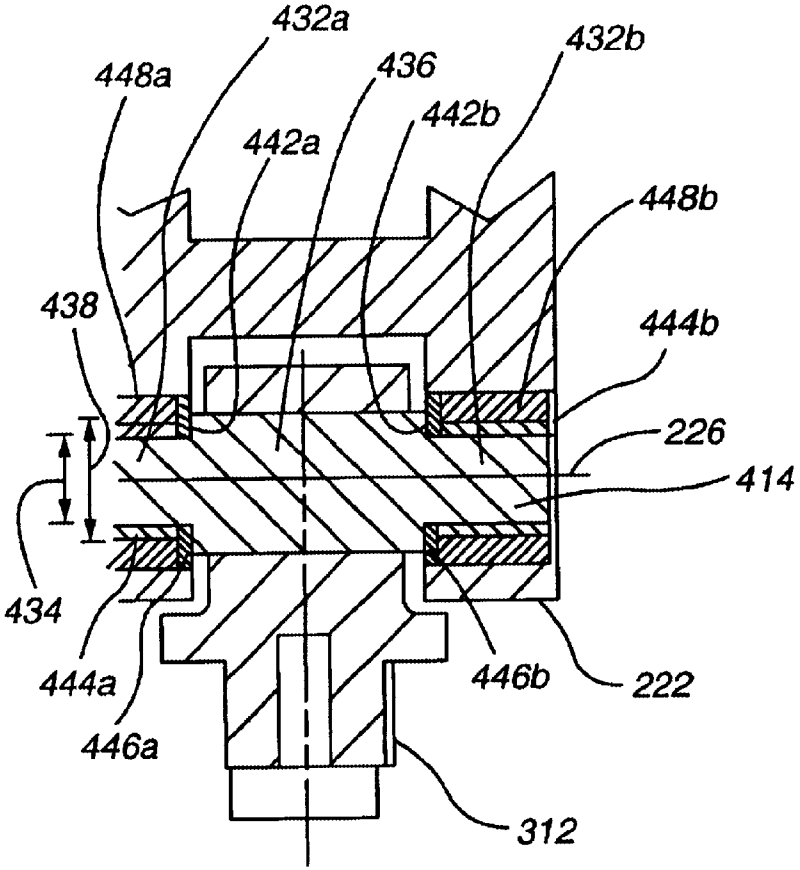
FIG. 5 is a cross-sectional view of a link connection with a pivot arm according to an embodiment of the present invention.

As depicted in FIG. 4, according to one embodiment of the invention, a link coupling is provided which uses a pin 414 having a noncylindrical or stepped profile (as depicted, with two steps). The depicted pin 414 has first and second outer cylindrical regions 432*a* 432*b* with a first diameter 434 and an inner cylindrical portion 436 with a second, larger diameter 438. First and second steps or shoulders 442*a,b* are defined on the pin 414 where the left and right outer cylindrical portions 432*a,b* meet the inner cylindrical portion 436. The pin 414 can be formed of a variety of materials and is preferably hardened tool steel.

First and second flanged bushings 444*a,b* provide flange regions 446*a,b* which are positioned adjacent and in contact with the shoulders of the pin 442*a,b* so that there is substantially no gap or spacing therebetween. Thus, the configuration of FIG. 4 provides for positioning of components in the thrust or pin-axis direction against a pin shoulder 442*a,b* (rather than only against a portion of the pivot arm 312). Thus, the operant or effective thrust-direction positioning in the configuration of FIG. 4 is positioning with respect to the pin shoulders 442*a,b*. The flanges 446*a,b* can be positioned substantially in contact with the shoulders 442*a,b*, thus eliminating any consequential gaps in the thrust-direction.

The bushings 444*ab* can be formed of a variety of materials. In one embodiment, the bushings 444*ab* are composite bushings. An example is IGUS bushing TFI 0405-06. In another embodiment, the bushings 444*ab* are formed of a highly wear-resistant material such as a Zirconia or Alumina.

If desired, the configuration of FIG. 4 can be implemented in a fashion that it can be retrofit into existing reformers, e.g., without the need to retool or reconfigure the H-link 222 or coupled components (such as a pivot arm 312). In the depicted embodiment, an outer bushing 448*a,b* is positioned outward of the flanged bushings 444*a,b*, e.g., to account for the relatively smaller diameter 434 of the pin outer portions (compared to the diameter of previous pins outer portions 314), and to accommodate pressing in from the outside.

In practice, when a link coupling as depicted in FIG. 4 is installed, the outer bushings 448*ab* are pressed over the flanged bushings 444*ab*. One pair of outer and flanged bushings 448*a* 444*a* is pressed, preferably from the outside, into the H-link 222. The stepped pin 414 is installed through the pivot arm 312 and into the first (installed) pair of outer and flanged bushings 448*a*, 444*a*. The second pair of outer and flanged bushings 448*b*, 444*b* are then pressed into the H-link sufficiently to force engagement of both pin shoulders 442*ab* with both bushing flanges 446*ab*, as depicted. This assembly process, accordingly, will result in assembly of a device having substantially no effective operational gaps in a thrust direction, merely from pressing-in the components as described. Accordingly, the assembly process of the present invention is believed to be substantially rapid, yet accurate, particularly when compared with assembly processes which previously might have included selection and/or shimming of thrust washers to try to achieve correct positioning, and the like.

In light of the above description, a number of advantages of the present invention can be seen. The present invention can provide reduced wear and increased time between production line shut-downs, such as time between shut-downs of as much as 6 months or more. The present invention can reduce the magnitude of wear during normal production line operation, thus reducing or delaying departures of the shape or position of the container bottom profile from intended shape or positions. The present invention can provide for relatively rapid replacement, repair or maintenance procedures such that, when production line shut-down is needed, the duration of the shut-down can be relatively short.

A number of variations and modifications of the present invention can be used. It is possible to use some aspects of the invention without using others. For example, it may be possible to provide an embodiment which is operable (even though it may not be the most desirable) in which a link pin is provided with only a single step or shoulder. The present invention can be implemented using a stepped link pin without using a bushing made of a ceramic material. Although an embodiment was described in which a bushing was provided with a flange, it is also possible to provide the flange function by way of a separate washer device. Although an embodiment was described in which a two- part outer bushing and flanged bushing were used, it is possible to provide embodiments in which a single bushing assembly is used. Although embodiments can be configured to provide the advantages of the present invention by retrofitting into current reformers, it is also possible to configure new reforming apparatus in conjunction with embodiments of the present invention, e.g., to provide H-links with reduced pin openings to accommodate the smaller-diameter outer portions of the pin, potentially eliminating the need for the depicted outer bushings. In general, it is preferred to configure the device to permit pressing-in of bushings and the like from the outside surface of the H-link. Although the present invention provides for right-angle shaped shoulders, operable devices can be configured with other shoulder shapes such as angled or conic sections and the like. Although certain component construction materials have been described, other construction materials can be used as will be clear to those of skill in the art after understanding the present disclosure. Although the present invention has been described in connection with reforming aluminum beverage container bottoms, there is no theoretical reason why the present invention cannot be implemented in other contexts such as reforming/reprofiling other portions of an aluminum beverage container and/or reforming or reprofiling other types of containers. It would be possible to provide configurations of the present invention in which the diameters of the pin end regions are non-equal. It would be possible to provide configurations of the present invention in which the coupling is used in connection with a bar-type link rather than an H-type link, e.g., such that the link provides only a single opening for each pivot axis. Similarly, it would be possible to provide configurations in which the pin passes through two or more aligned openings of the pivot arm or other reformer component.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g. for improving performance, achieving ease and/or reducing cost of implementation. The present invention includes items which are novel, and terminology adapted from previous and/or analogous technologies, for convenience in describing novel items or processes, do not necessarily retain all aspects of conventional usage of such terminology.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. Apparatus for providing a link coupling in a reformer for an aluminum container bottom comprising:

a rigid link in said reformer having first and second aligned openings defining at least a first link pivot axis;

a pin extending through said first and second aligned link openings and through at least a component of the reformer, wherein said pin has a first and a second end region with a substantially cylindrical shape defining a first diameter and a central cylindrical region between said first and said second end regions and defining a second diameter greater than said first diameter, wherein a first annular shoulder is defined between said pin first end region and said pin central region and a second annular shoulder is defined between said pin second end region and said pin central region, wherein said first and second end regions are aligned with said first and second aligned link openings and said central region of said pin is aligned with an opening of said reformer component; and a first and a second bushing and a first and a second flanges respectively positioned around said first and said second pin end regions, wherein said first and said second flanges are in operable contact with said first and second annular shoulders.

2. An apparatus, as claimed in claim 1, wherein at least said first flange is integrally formed with said first bushing.

3. An apparatus, as claimed in claim 1, wherein at least said first flange is separate and distinct from said first bushing.

4. An apparatus, as claimed in claim 1, further comprising first and second outer bushings respectively positioned between said first and second bushings and said rigid link.

5. An apparatus, as claimed in claim 1, wherein said first and second bushings are formed of tool steel.

6. An apparatus, as claimed in claim 1, wherein said first and second bushings are formed of a ceramic material.

7. Apparatus for providing a link coupling and a reformer for an aluminum container bottom comprising:

rigid link means in said reformer having first and second aligned openings defining at least first link pivot axis;

pin means extending through said first and second aligned link openings and through at least a component of said reformer wherein said pin means has first and second end regions with a substantially cylindrical shape defining a first diameter and a central cylindrical region between said first and second end regions defining a second diameter greater than said first diameter, wherein a first annular shoulder means is defined between said pin means first end region and said pin means center region and a second annular shoulder means is defined between said pin means second end region and said pin means central region; wherein said first and second pin means end regions aligned with said first and second aligned link openings and said central region of said pin means is aligned with an opening of said reformer component; and a first and a second bushing means and a first and second flange means respectively positioned around said first and second pin means end regions, wherein said first and said second flange means respectively contact said first and second shoulders means to substantially eliminate any gaps between said first and said second shoulders and an outer bushing positioned in concentric engagement with said first and said second bushing means.

8. Apparatus as claimed in claim 7 wherein at least said first flange means is integrally formed with said first bushing means.

9. Apparatus as claimed in claim 7 wherein at least said first flange means is separate and distinct from said first bushing means.

10. Apparatus as claimed in claim 7 further comprising first and second outer bushing means respectively positioned between said first and second bushing means and said rigid link means.

11. Apparatus as claimed in claim 7 wherein said first and second bushing means are formed of stainless steel.

12. Apparatus as claimed in claim 7 wherein said first and second bushing means are formed of a ceramic material.

13. An apparatus as claimed in claim 1, wherein said first and second bushings are composite bushings including both ceramic material and metal.

14. The apparatus of claim 7, wherein said first and second flange means are oriented at a substantially 90 degree angle to a longitudinal axis of said pin means.

* * * * *